US010118431B2

(12) United States Patent
To

(10) Patent No.: US 10,118,431 B2
(45) Date of Patent: Nov. 6, 2018

(54) RING FOR RING BINDER MECHANISM

(75) Inventor: Chun Yuen To, Hong Kong (CN)

(73) Assignee: World Wide Stationery Mfg. Co., Ltd., Kwai Chung, New Territories (HK)

( * ) Notice: Subject to any disclaimer, the term of this patent is extended or adjusted under 35 U.S.C. 154(b) by 3646 days.

(21) Appl. No.: 11/620,169

(22) Filed: Jan. 5, 2007

(65) Prior Publication Data

US 2008/0008519 A1 Jan. 10, 2008

(30) Foreign Application Priority Data

Jul. 6, 2006 (CN) ..... 2006 3 0131068
Jul. 6, 2006 (CN) ..... 2006 3 0131069

(51) Int. Cl.
*B42F 13/26* (2006.01)

(52) U.S. Cl.
CPC ..... *B42F 13/26* (2013.01)

(58) Field of Classification Search
CPC ..... B42F 13/00; B42F 13/22; B42F 13/26
USPC ..... 281/31; 402/19, 31, 36, 37, 38, 39, 41, 402/73; D19/26, 27; 99/31
See application file for complete search history.

(56) References Cited

U.S. PATENT DOCUMENTS

| | | | | |
|---|---|---|---|---|
| 1,473,254 | A | | 11/1923 | Nachtrieb |
| 2,103,307 | A | | 12/1937 | Unger |
| 2,371,474 | A | | 3/1945 | Seelman |
| 3,827,111 | A | | 8/1974 | O'Connell |
| 4,552,478 | A | * | 11/1985 | Cohen ..... 402/39 |
| 4,792,253 | A | | 12/1988 | Jacobson |
| 5,106,222 | A | | 4/1992 | D'Amore |
| 5,332,327 | A | | 7/1994 | Gillum |
| D356,112 | S | | 3/1995 | Constantine |
| D382,593 | S | | 8/1997 | To |
| 5,718,529 | A | | 2/1998 | Chan |
| 5,772,348 | A | | 6/1998 | To |
| 5,975,785 | A | | 11/1999 | Chan |
| 6,007,266 | A | | 12/1999 | Cheng |
| 6,033,144 | A | | 3/2000 | Ng |
| 6,045,286 | A | | 4/2000 | Tung |
| 6,749,357 | B2 | | 6/2004 | Cheng |
| 6,758,621 | B2 | | 7/2004 | To |

(Continued)

OTHER PUBLICATIONS

Admitted Prior Art (A), 1 Page.

(Continued)

*Primary Examiner* — Justin V Lewis
(74) *Attorney, Agent, or Firm* — Senniger Powers LLP

(57) ABSTRACT

A ring binder mechanism for holding loose-leaf pages includes a housing and a plurality of rings for holding the loose-leaf pages. Each ring has a first ring member and a second ring member. The first ring member is movable relative to the housing and the second ring member between a closed position and an opened position. In the closed position, the first and second ring members form a substantially continuous, closed loop for allowing loose-leaf pages retained by the rings to be moved along the rings from one ring member to the other. In the opened position, the first and second ring members form a discontinuous, open loop for adding or removing loose-leaf pages. The first and second ring members are generally mirror images of each other. Each of the ring members has a length and at least two different radii of curvature along the length of the rings.

27 Claims, 12 Drawing Sheets

(56) References Cited

U.S. PATENT DOCUMENTS

| | | | | |
|---|---|---|---|---|
| 7,241,067 | B2 | 7/2007 | Cheng | |
| 7,275,886 | B2 | 10/2007 | Cheng | |
| 7,296,946 | B2 | 11/2007 | Cheng | |
| 7,404,685 | B2 | 7/2008 | Cheng | |
| D582,477 | S | 12/2008 | To | |
| D585,935 | S | 2/2009 | To | |
| 7,491,006 | B2 | 2/2009 | Whaley | |
| 7,524,128 | B2 | 4/2009 | Cheng | |
| 7,527,449 | B2 | 5/2009 | Petrie | |
| 7,530,755 | B2 | 5/2009 | Whaley | |
| 7,549,817 | B2 | 6/2009 | Cheng et al. | |
| D598,494 | S | 8/2009 | To | |
| 7,637,682 | B2 | 12/2009 | To | |
| 7,654,764 | B2 | 2/2010 | To | |
| D616,023 | S | 5/2010 | To | |
| 2004/0037614 | A1* | 2/2004 | Busam et al. | 402/73 |
| 2005/0201818 | A1 | 9/2005 | Cheng | |
| 2005/0207826 | A1 | 9/2005 | Cheng et al. | |
| 2005/0214064 | A1 | 9/2005 | Ng et al. | |
| 2006/0216107 | A1 | 9/2006 | Lin | |
| 2006/0251467 | A1 | 11/2006 | Cheng | |
| 2007/0086836 | A1 | 4/2007 | Cheng | |
| 2008/0075526 | A1 | 3/2008 | Ng et al. | |

OTHER PUBLICATIONS

Admitted Prior Art (B), 1 Page.
Admitted Prior Art (C), 1 Page.
World Wide Stationery Manufacturing Company Limited, publication date unknown (admitted prior art—A).
World Wide Stationery Manufacturing Company Limited, publication date unknown (admitted prior art—B).
World Wide Stationery Manufacturing Company Limited, publication date unknown (admitted prior art—C).

* cited by examiner

RING FOR RING BINDER MECHANISM

BACKGROUND OF THE INVENTION

The present invention generally relates to a ring binder mechanism for retaining loose-leaf pages, and in particular to a generally C-shaped ring for a ring binder mechanism.

Ring binder mechanisms (e.g., the prior art ring binder mechanism shown in FIGS. 1-3) include ring members for retaining loose-leaf pages, such as hole-punched pages, in a file or notebook. The ring members may be selectively opened to add and/or remove pages, or closed to retain the pages while allowing the pages to be moved along the ring members. The ring members of the ring binder mechanism of FIG. 1 are shown in FIGS. 2 and 3 removed from the ring binder mechanism and in the closed position. In FIG. 3, the ring members are illustrated retaining loose-leaf pages.

A drawback to these known ring members is that they are circular, which significantly limits the amount of loose-leaf pages that can be retained by the ring members. Loose-leaf pages retained by the rings are most often in one of three positions depending on whether the notebook is in an open position or a closed position. In the open position, loose-leaf pages are most often near the bases of the ring members adjacent either side of the housing. In FIG. 3, for example, the pages are stacked near the base of the right ring member as viewed. Pages are typically only moved across the other portions of the ring when the notebook is opened. In the closed position of the notebook, the pages are often near the tips of the ring members. As a result, large segments of the rings between the sides of the ring and the top of the ring are unavailable to store pages. Instead, pages are usually just past by these segments during movement of the pages from one ring member to the other. Thus, significant portions of the circular shaped ring members are unused to retain pages.

As a result, there is a desire for a ring binder mechanism having rings configured to support more loose-leaf pages than circular rings of comparable size.

SUMMARY OF THE INVENTION

A ring binder mechanism for holding loose-leaf pages generally comprises a housing and a plurality of rings for holding the loose-leaf pages. Each ring includes a first ring member and a second ring member. The first ring member is movable relative to the housing and the second ring member between a closed position and an opened position. In the closed position, the first and second ring members form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. The first and second ring members are generally mirror images of each other. Each of the ring members has a length and at least two different radii of curvature along the length of the rings.

In another aspect, a ring binder mechanism for holding loose-leaf pages comprises a housing and a plurality of rings for holding the loose-leaf pages. Each ring includes a first ring member and a second ring member. The first ring member is movable relative to the housing and the second ring member between a closed position and an opened position. In the closed position, the first and second ring members form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. The first and second ring members are generally mirror images of each other. Each of the ring members has a middle segment being substantially straight and extending generally vertically upward from the housing and adapted to receive a stack of loose-leaf pages.

In yet another aspect, a ring binder mechanism for holding loose-leaf pages comprises a housing and a plurality of rings for holding the loose-leaf pages. Each ring includes a first ring member and a second ring member. The first ring member is movable relative to the housing and the second ring member between a closed position and an opened position. In the closed position, the first and second ring members form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. Each of the first and second ring members are shaped so that in the closed position they cooperatively define a generally straight top section of the ring.

In still another aspect, a ring binder mechanism for holding loose-leaf pages comprises a housing and a plurality of rings for holding the loose-leaf pages. Each ring includes a first ring member and a second ring member. The first ring member is movable relative to the housing and the second ring member between a closed position and an opened position. In the closed position, the first and second ring members form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. The first and second ring members are generally mirror images of each other. Each of the ring members comprises a first segment having a first radius of curvature, a second segment having a second radius of curvature, and a third segment having a third radius of curvature substantially greater than the first radius of curvature and the second radius of curvature.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
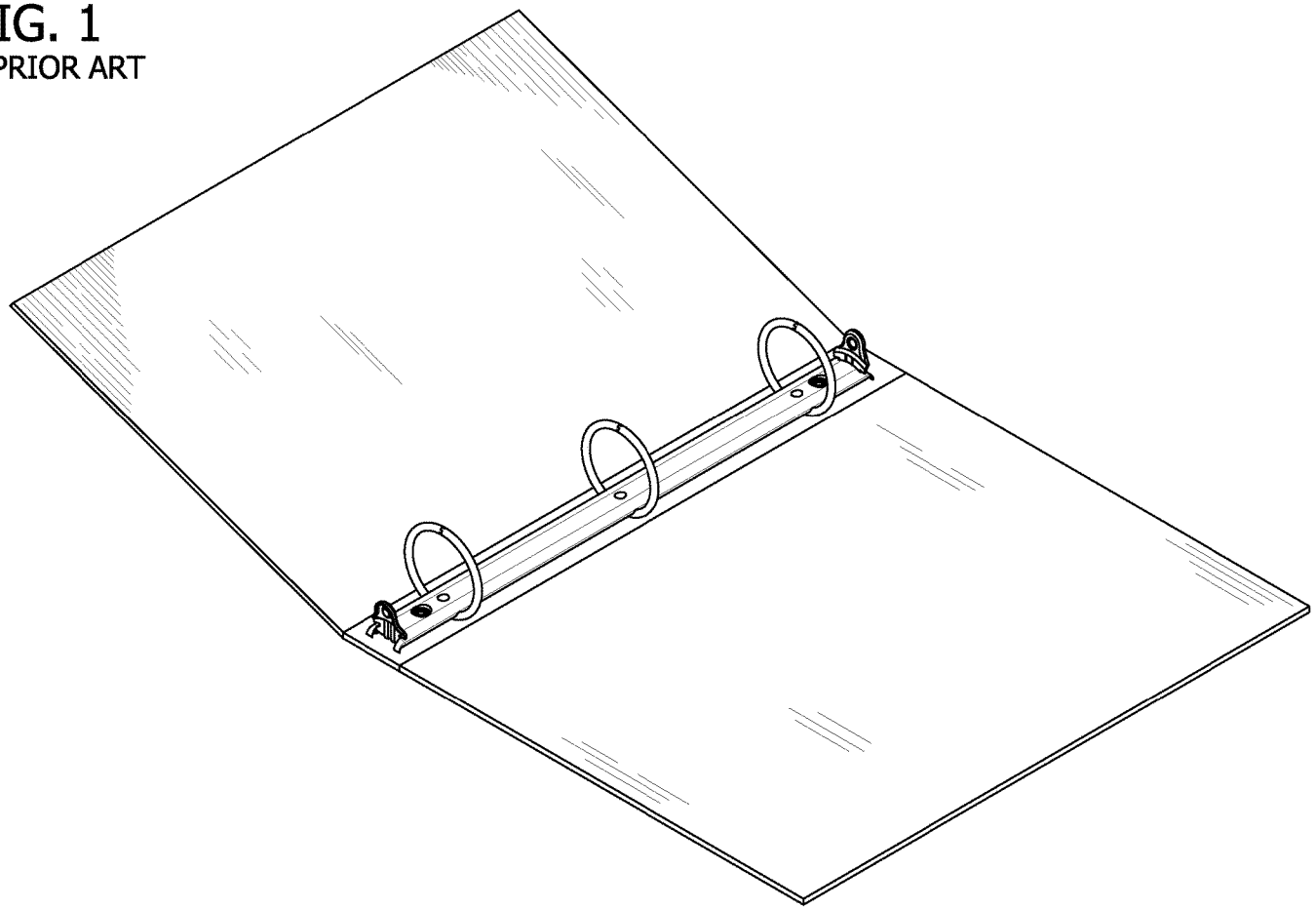
FIG. 1 PRIOR ART
FIG. 1 is a perspective of a notebook incorporating a prior art ring binder mechanism.
Figure 2:
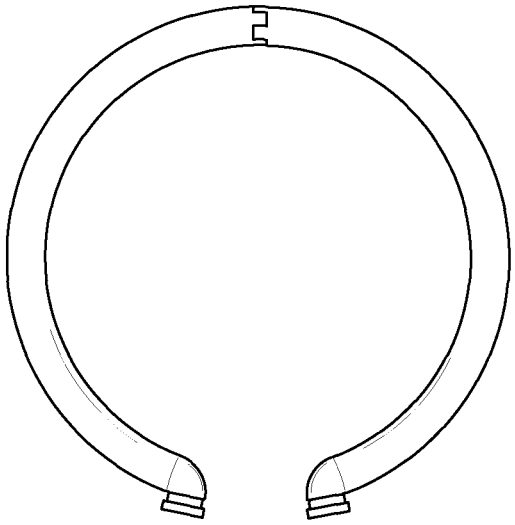
FIG. 2 PRIOR ART
FIG. 2 is an enlarged plan view of a ring removed from the prior art ring binder mechanism of FIG. 1.
Figure 3:
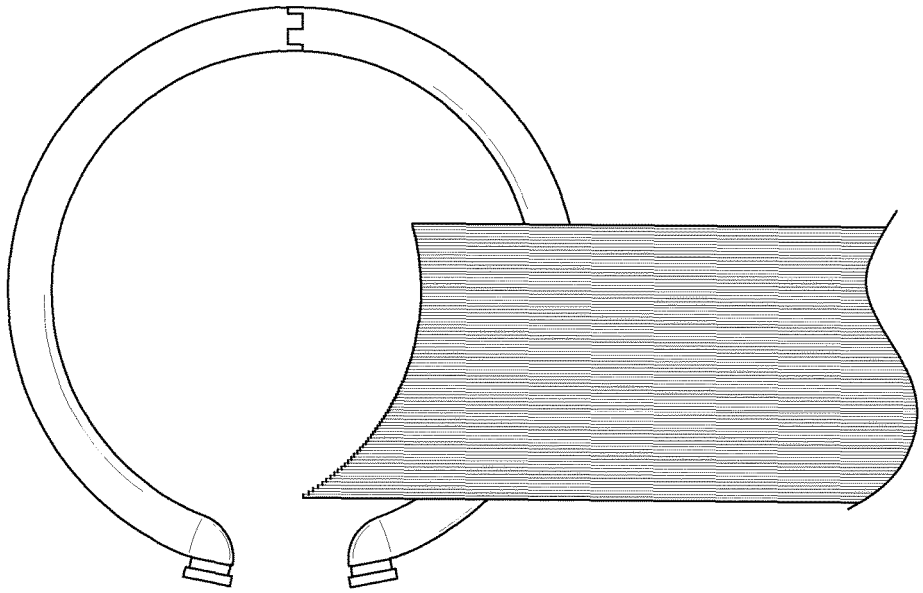
FIG. 3 PRIOR ART
FIG. 3 is substantially the same as FIG. 2 but showing loose-leaf pages being retained by the ring.
Figure 4:
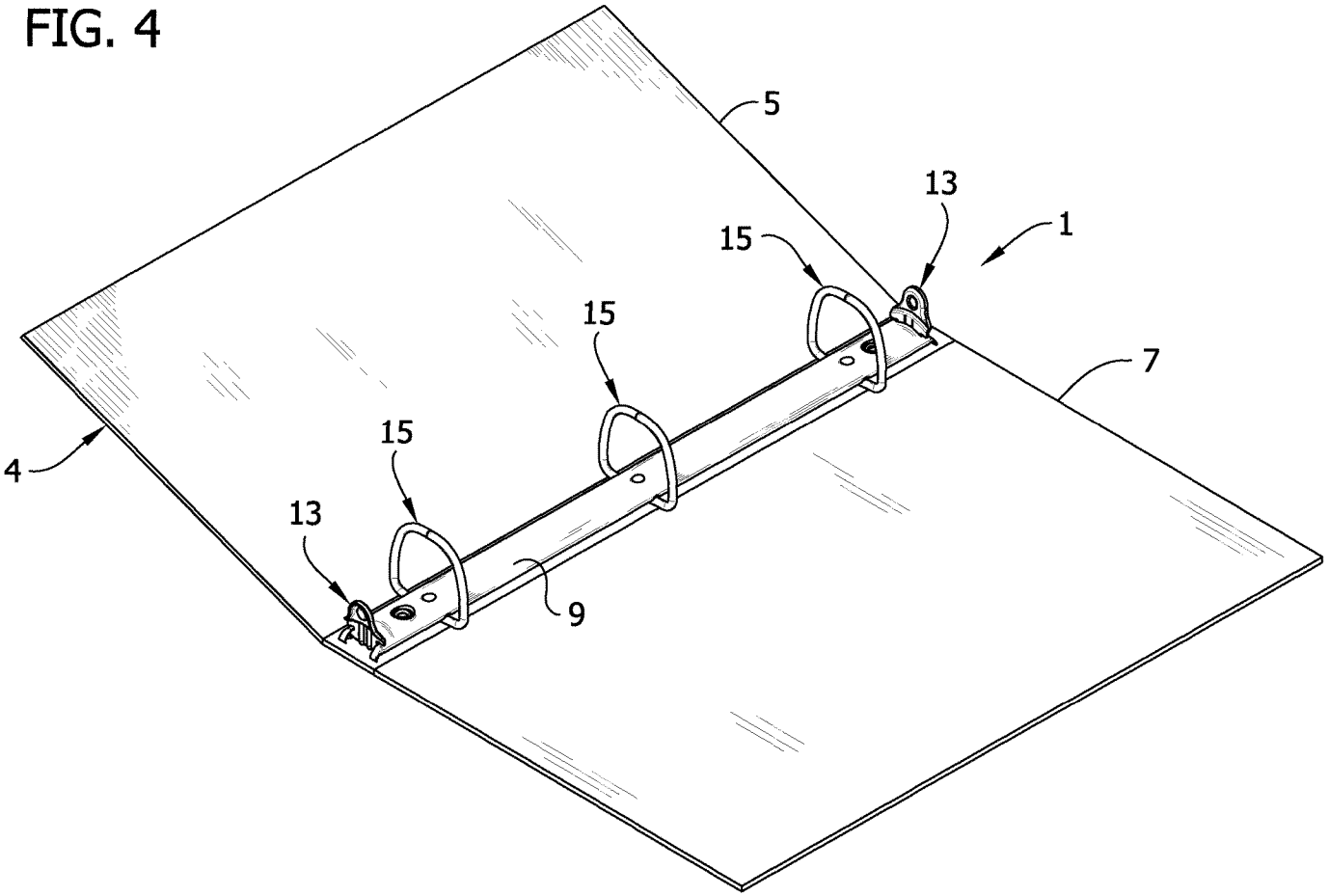
FIG. 4 is a perspective of a notebook incorporating one embodiment of a ring binder mechanism having generally C-shaped rings.

Referring now to the drawings, and particularly to FIG. 4, a ring binder mechanism is designated generally by reference numeral 1. The mechanism 1 is shown mounted on a spine 3 of a notebook 4 having a front cover 5 and a back cover 7 hingedly attached to the spine. The front and back covers 5, 7 are movable to selectively cover or expose loose-leaf pages (not shown in FIG. 4) retained by the mechanism 1. Ring binder mechanisms mounted on notebooks in other ways or on surfaces other than a notebook, for example, a file, do not depart from the scope of this invention.

Figure 5:
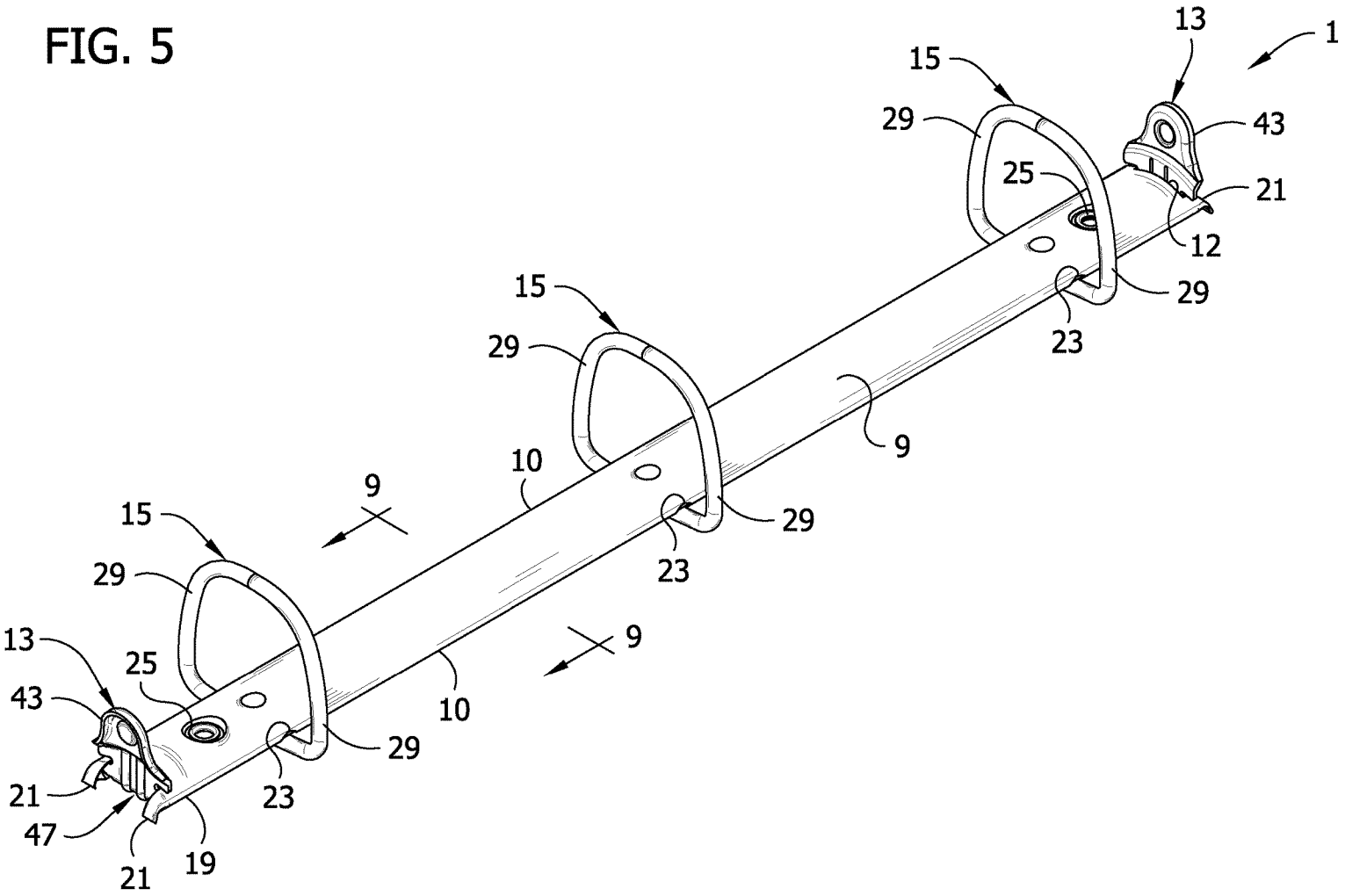
FIG. 5 is a top perspective of the ring binder mechanism of FIG. 4 with the rings in a closed position.

As shown in FIGS. 4 and 5, the ring binder mechanism 1 includes an elongate housing 9 that supports two substantially similar actuating levers (each designated generally by reference numeral 13) and three rings (each designated generally by reference numeral 15). The housing 9 is symmetrical with a roughly arch-shaped cross section (FIG. 9) and includes a longitudinal axis, two transversely opposite longitudinally extending edges 10, and two longitudinal ends 12. Each lever 13 pivotally mounts on the housing 9, generally at an opposite longitudinal end 12, for controlling movement of the rings 15 between a closed position (FIGS. 4-6) and an open position (FIG. 7).

Figure 6:
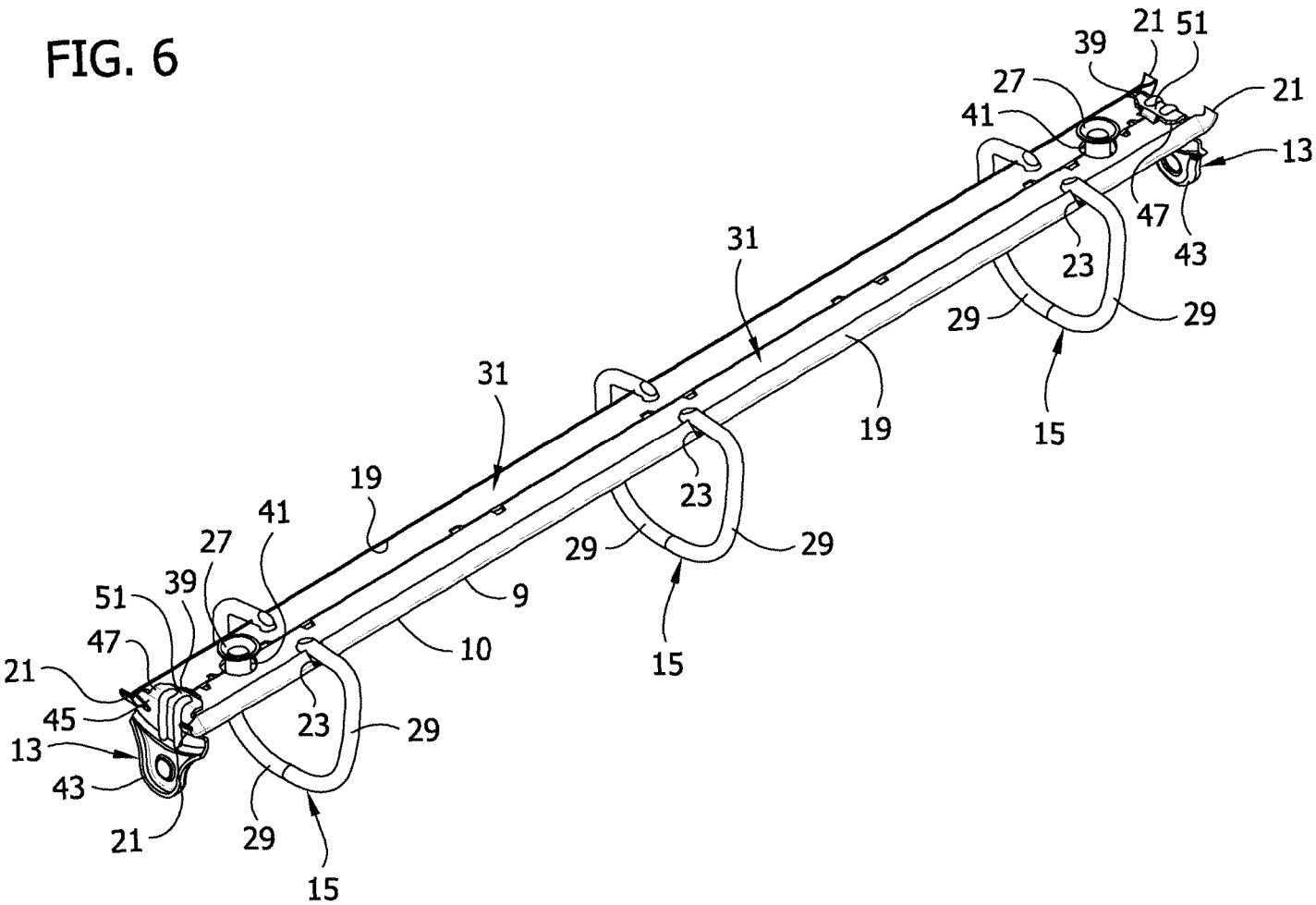
FIG. 6 is a bottom perspective of the ring binder mechanism with the rings in the closed position.

As best shown in FIG. 6, a bent under rim 19 is formed along each longitudinal edge of the housing 9, extending the full length of the housing from one longitudinal end 12 to the other. Each end of the two bent under rims 19 is pinched together with a segment of an upper surface of the housing 9 to form four pockets 21. Accordingly, there are two pockets 21 extending longitudinally outward from each longitudinal end 12 of the housing 9. Six total slots 23 (or cutouts) are positioned along the two bent under rims 19. Only three of the slots 23 are shown in FIGS. 5-8. The slots 23 are arranged in three transversely opposed pairs with each pair receiving one of the rings 15, allowing each ring to move laterally of the housing 9 for opening and closing.

Figure 7:
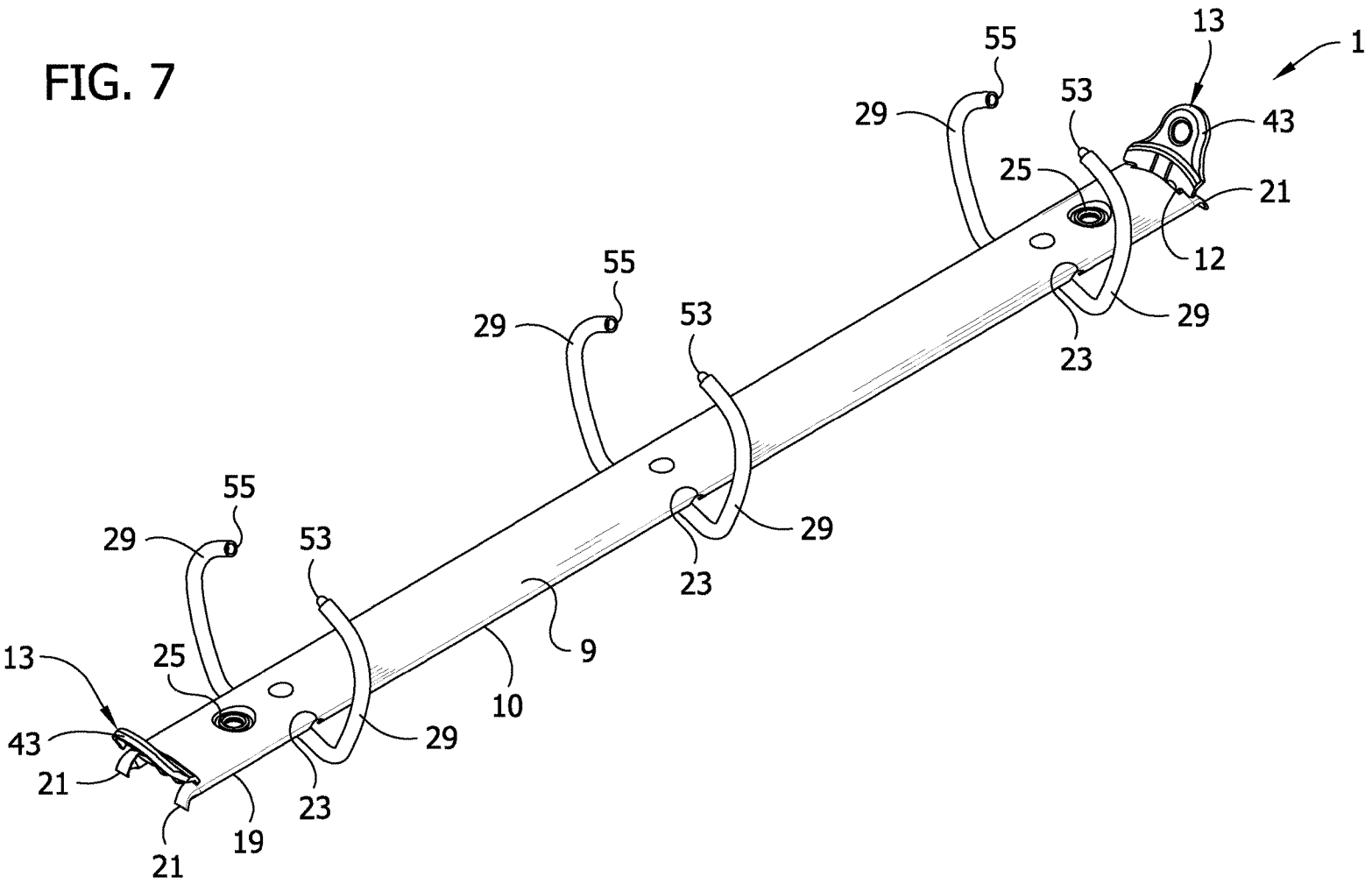
FIG. 7 is a top perspective of the ring binder mechanism with the rings in an opened position.
Figure 8:
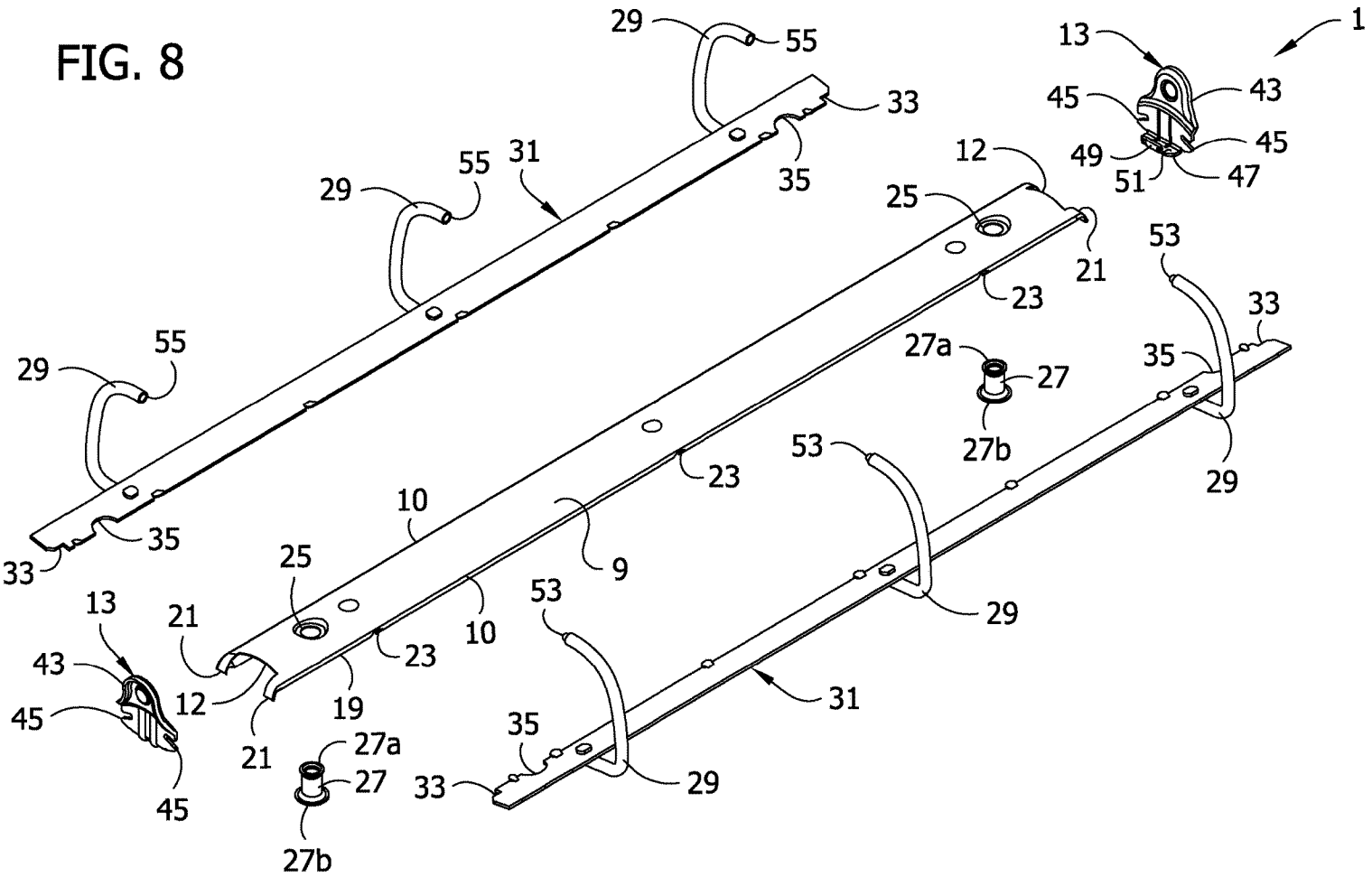
FIG. 8 is a top exploded perspective of the ring binder mechanism.

Referring to FIG. 8, two circular openings 25 are provided in the upper surface of the housing 9, near the longitudinal ends 12, each receiving and attaching mounting structure to the housing 9 (in the mechanism illustrated in FIGS. 4-9, the mounting structure includes two posts 27), supporting the mechanism 1 above the spine 3 of the notebook. It is envisioned that the housing of the present invention is made of metal, but it may be made of any other suitable material that is sufficiently rigid to provide a stable mount for components of the mechanism. In addition, different shaped housings, including asymmetrical ones, do not depart from the scope of this invention.

The rings 15 each include two ring members 29 which are movable relative to one another between a closed position (FIGS. 4-6) and an open position (FIG. 7). In the closed position, the ring members 29 form a substantially continuous, closed ring or loop for retaining loose-leaf pages and for allowing the pages to move along the rings 15 from one ring member 29 to the other. In the open position, the ring members 29 form a discontinuous, open loop suitable for adding and/or removing pages.

It is envisioned that the ring members are formed from a cylindrical rod of suitable material, such as steel. But it is understood that ring members having a different cross section or ring members made of different material do not depart from the scope of the present invention. Although in the illustrated mechanism both ring members can move, mechanisms having one movable ring member and one fixed do not depart from the scope of the invention. In addition, mechanisms with more or less than three rings do not depart from the scope of this invention.

With reference to FIGS. 7 and 8, each of the ring members 29 includes a tip adapted to engage the tip of an adjacent ring member in the closed position of the ring 15. In the illustrated configuration, the tip of one of the paired ring members 29 includes a pin 53 and the tip of the adjacent ring member includes a socket 55 for receiving the pin. It is understood that the tips can have different configurations without departing from the scope of this invention.

As shown in FIG. 8, the two ring members 29 of each ring 15 are mounted opposite each other on one of a pair of hinge plates (each hinge plate being designated generally by reference numeral 31). The hinge plates 31 are each thin and elongate, having an inner and an outer longitudinal edge margin and two longitudinal ends. Each hinge plate 31 additionally includes two squared notches 33 and two rounded cutouts 35, each of which are located along the inner longitudinal edge margin of the hinge plate. The two notches 33 are each located at an opposite longitudinal end of the hinge plate 31, and the two cutouts 35 are each located inward from one of the respective notches 33 but still generally adjacent the hinge plates' ends.

The hinge plates 31 attach to one another in parallel arrangement along their inner longitudinal edge margins, forming a central hinge having a pivot axis (FIG. 6). The housing 9 loosely receives the outer longitudinal edge margins of the interconnected hinge plates 31 above its two bent under rims 19. Thus, the hinge plates 31 are retained on the housing 9 while the outer longitudinal edge margins are free to move within the rims 19. Corresponding notches 33 of the adjoining hinge plates align to form two box-shaped recesses 39 at opposite longitudinal ends of the plates 31. These recesses 39 are sized and shaped to interact with the actuating levers 13, as will be described in more detail hereinafter. Similarly, corresponding cutouts 35 align to form two openings 41, each sized and shaped for receiving one of the posts 27 through the hinge plates 31.

The housing 9 is slightly narrower than the joined hinge plates 31 when the hinge plates are in a coplanar position (i.e., an angle between exterior surfaces of the hinge plates is 180°). Accordingly, as the hinge plates 31 pivot through this position, they deform the resilient housing 9 and cause a spring force in the housing that urges the hinge plates 31 to pivot away from the coplanar position, either closing the ring members 29 (i.e., moving the pivot axis down and away from the housing's upper surface (FIG. 9)) or opening them (i.e., moving the pivot axis up and toward the housing's upper surface). Moreover, when the ring members 29 are closed, the spring force of the housing 9 resists hinge plate movement and clamps the ring members 29 together. When the ring members 29 are open, the spring force of the housing 9 holds them apart.

Referring to FIGS. 5 and 8, each of the two actuating levers 13 includes a relatively flat head 43 that extends upward from the lever 13, generally above the housing 9, for grasping to pivot the lever. Each lever 13 additionally includes two lateral arms 45 and a cam 47. The lateral arms 45 extend laterally outward from opposite sides of each lever 13 below the flat head 43. The two arms 45 of each lever loosely fit within the two pockets 21 located at each longitudinal end of the housing 9, allowing the levers 13 to pivot within the pockets 21 relative to the housing about an axis transverse to the housing. The cam 47 of each lever is integrally attached to the lever 13 below the lateral arms 45. It extends downward from the arms 45 and curves outward from the flat head 43, fitting into one of the respective box-shaped recesses 39 of the hinge plates. An enlarged tab 49 of each cam fits loosely over the interconnected hinge plates 31 while a base of each cam rests below the plates. The cam 47 releasably locks the hinge plates 31 therebetween for operable engagement to control the pivoting motion of the hinge plates that close and open the ring members 29. In operation to close the ring members 29, the levers 13 are pivoted upward and inward. The tabs 49 engage a top surface of the hinge plates 31 and pull the pivot axis of the plates downward.

To open the ring members 29, the levers 13 are pivoted outward and downward. The bases 51 of the cam 47 engage a bottom surface of the hinge plates 31 and push the pivot axis of the plates upward. Mechanisms (not shown) having levers with different shapes or levers pivotally attached to a housing differently do not depart from the scope of the present invention. In addition, mechanisms having only one lever for driving the hinge plates do not depart from the scope of the present invention.

Referring now to FIG. 6, the two posts 27 are located adjacent the levers 13 and space the ring binder mechanism 1 off the notebook 4 so that the hinge plates 31 can pivot without engaging the spine 3. In this position, the posts 27 align with the openings 41 of the interconnected hinge plates 31 and pass through the hinge plates without interfering with their operation. Each post 27 is tubular in shape and has two open ends. At a first end, the post 27 includes a deformable lip 27*a* that attaches the post to one of the circular openings 25 in the upper surface of the housing 9 (FIG. 8). At a second end, the post 27 includes a flange 27*b* that extends outward from the post for supporting the post on the spine 3. Mechanisms secured to a notebook or other surfaces differently than described and illustrated herein do not depart from the scope of the present invention.

Figure 9:
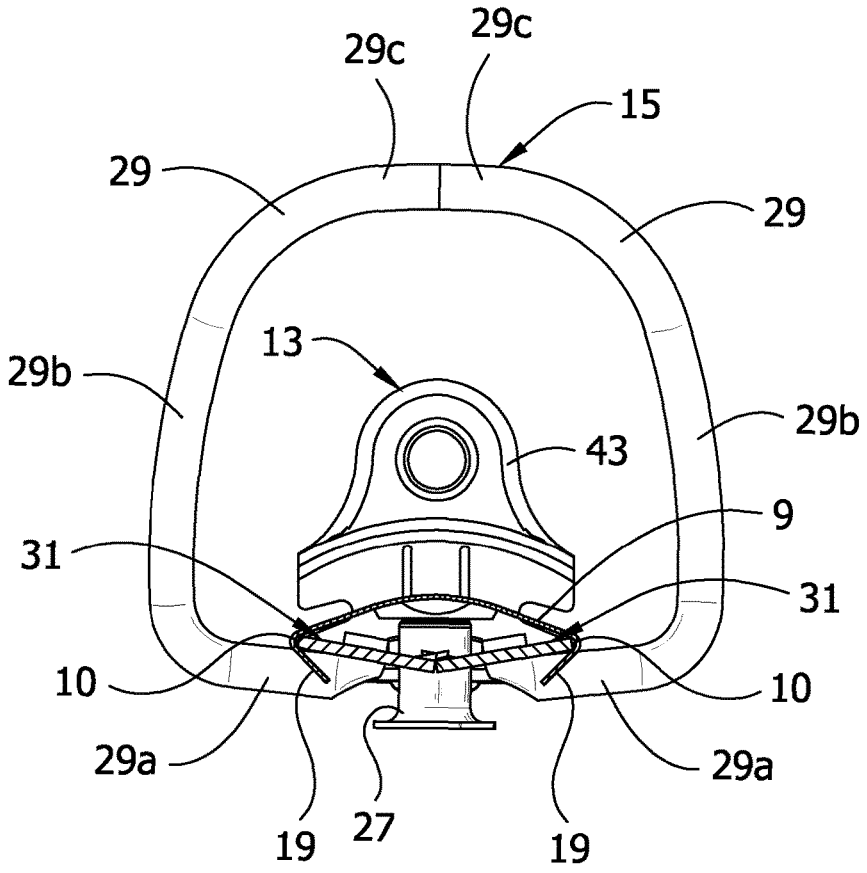
FIG. 9 is a section taken on line 9-9 of FIG. 5.
Figure 10:
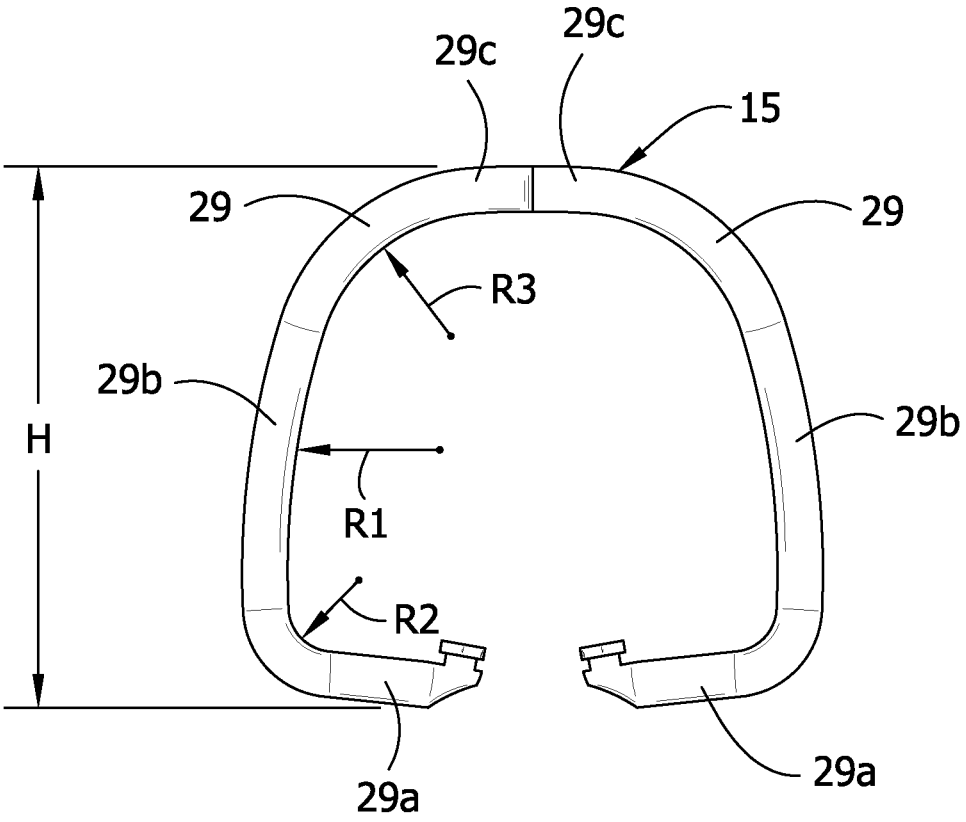
FIG. 10 is an enlarged plan view of one of the C-shaped rings removed from the ring binder mechanism.
Figure 11:
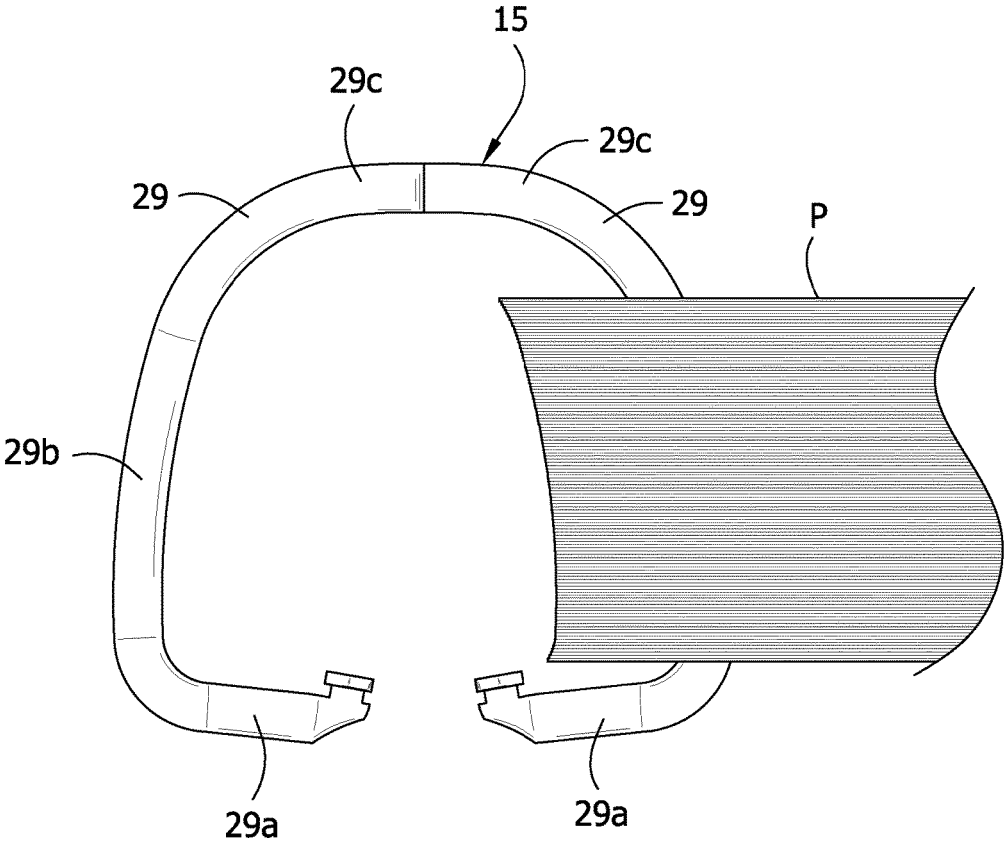
FIG. 11 is substantially the same as FIG. 10 but showing loose-leaf pages being retained by the ring.

With reference now to FIGS. 9-11, each of the ring members 29 has a lower segment 29*a* that extends laterally outward from the housing 9 in a generally horizontal plane and curves upward at its outer end. A middle segment 29*b* of the ring member 29 extends generally vertically upward (i.e., vertically above the housing 9) from the curved up end of the lower segment 29*a*. The middle segment 29*b* defines a generally straight (e.g., a radius of curvature greater than about 2 inches) segment of the ring member 29*a* adapted to receive loose-leaf pages. Curving generally inward and extending horizontally from an upper end of the middle segment 29*b* of ring members 29 is an upper segment 29*c* for vertically spaced relationship with the housing 9. The upper segment 29*c* extends to a position generally above the longitudinal axis, or centerline, of the housing 9 as well as with the hinge line of the hinge plates 31. The segments 29*a*-29*c* cooperatively define a generally C-shaped ring member 29.

In the closed position of the rings (FIG. 9), the joined ring members 29 cooperatively form a generally trapezoid shaped ring 15, with the upper and lower segments 29*c*, 29*a* of the ring members 29 being generally parallel to each other. The middle segment 29*b* slopes slightly inward toward the housing 9 as it extends from the lower segment 29*a* up to the upper segment 29*c*. In the illustrated configuration, the middle segment 29*b* of each ring member 29 has a slope greater than three. More particularly, the middle segment 29*b* of each ring member 29 has a slope of about four. As a result, the middle segments 29*b* of opposing ring members 29 taper slightly toward each other as they extend away from the housing 9.

In addition, the middle segment 29*b*, which is generally straight does have a slight arcuate component to it. In the illustrated embodiment, for example, the middle segment 29*b* has a radius of curvature R1 greater than about 2 inches. More specifically, the middle segment 29*b* has a radius of curvature R1 of about 2.2 inches. It is understood, however, that the middle segment 29*b* could be straight. The lower segment 29*a* has a radius of curvature R2 of about 0.1 inch and the upper segment 29*c* has a radius of curvature R3 of about 0.5 inches. Thus, the lower and upper segments 29*a*, 29*c* each include a radius of curvature R2, R3 that is less than about 0.5 inches. Accordingly, each of the ring members 29 includes at least two different radii along its length. It is understood that the radius of curvature of the ring members can be different from those described herein without departing from the scope of this invention.

The total height H of each of the ring members 29 in the illustrated embodiment is approximately 1.4 inches. The lower segment 29*c* of each ring member 29 has a length of about 0.6 inches, the middle segment 29*b* has a height of about 0.8 inches, and the upper segment has a length of about 0.7 inches. As a result, the height of the middle segment 29*b* is greater than 33 percent of the total height of the ring member 29, more particularly greater than 50 percent of the total height of the ring member, and even more particularly greater than 60 percent of the total height of the ring member. The ring 15 is adapted to receive a stack of loose-leaf pages that has a height greater than 50 percent of the total height of the ring members 29. It is understood that the ring members 29*a* can have dimensions other than those disclosed herein without departing from the scope of the invention.

In the closed position of the rings 15, the upper segments 29*c* of the first and second ring members 29 cooperatively define a generally straight segment of the rings. The straight segment (i.e., top segment) has a radius of curvature that is greater than about 2 inches. For example, the radius of curvature of the substantially straight segment of the illustrated ring 15 is about 3 inches. The straight segment has a length that is about equal to a width of the housing 9. It is understood that the rings and ring members can have different dimensions, shapes, radius of curvatures and configurations without departing from the scope of this invention.

Figure 12:
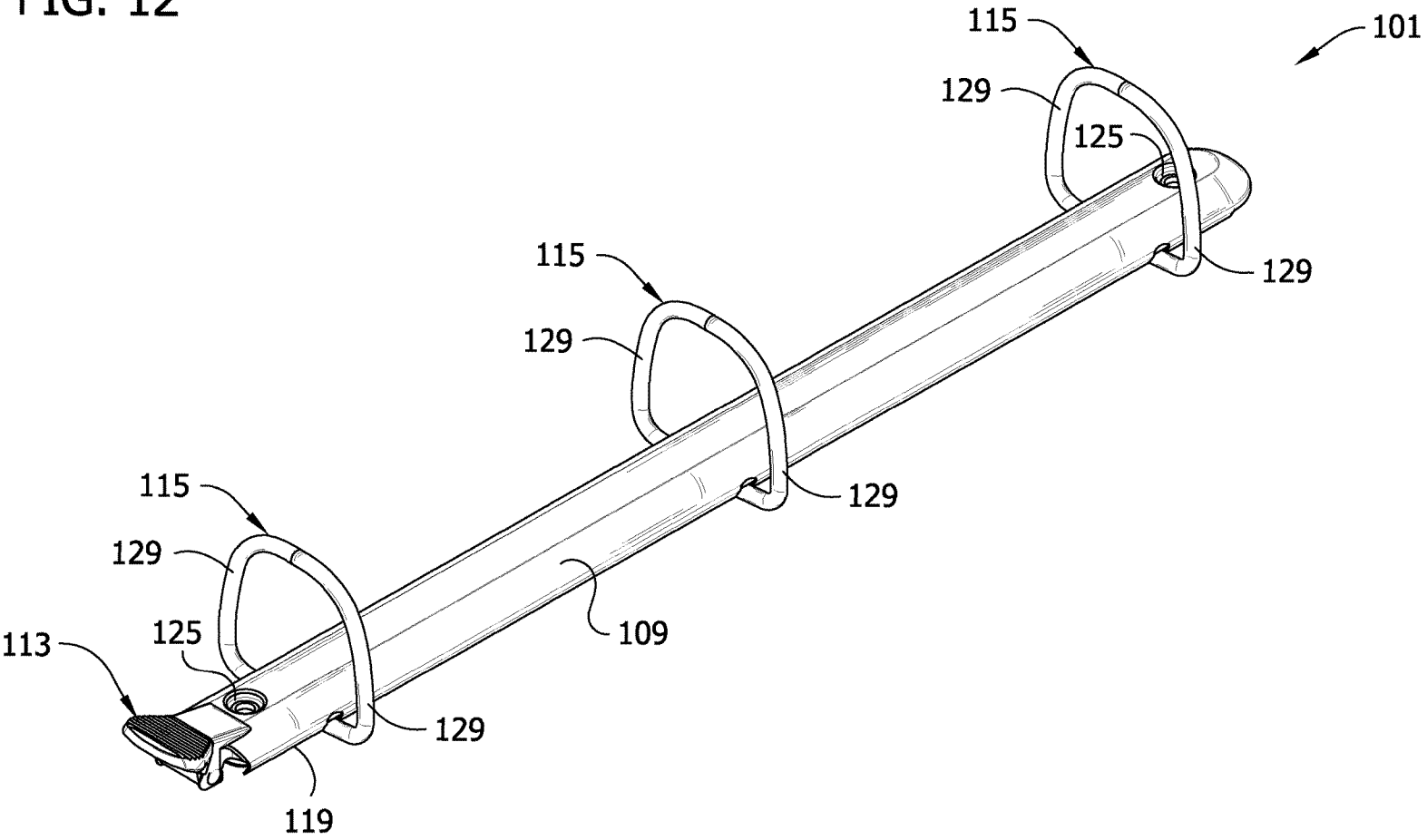
FIG. 12 is a top perspective of another embodiment of a ring binder mechanism having generally C-shaped rings with the rings in a closed position.

FIG. 12 shows another embodiment of a ring binder mechanism 101 having generally C-shaped rings 115. The rings 115 of this configuration are substantially the same as the rings 15 of the mechanism 1 of FIGS. 1-7. Corresponding parts of this mechanism 101 configuration are indicated by the same reference numbers as the previous mechanism 1, plus "100". The ring binder mechanism 101 of FIG. 12 (other than the rings 115) is described in detail in U.S. Provisional Patent Application Ser. No. 60/827,205, filed Sep. 27, 2006 which is hereby incorporated by reference in its entirety. It is understood that the generally C-shaped rings 15, 115 can be fitted on ring binder mechanisms other than those described and shown herein.

Components of the mechanism of the present invention are made of a suitable rigid material, such as metal (e.g.

steel). But mechanisms made of a non-metallic material, specifically including plastic, do not depart from the scope of this invention.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above ring binder mechanisms without departing from the scope of the invention, it is intended that all matter contained in the above description and shown in the accompanying drawings shall be interpreted as illustrative and not in a limiting sense.

What is claimed is:

1. A ring binder mechanism for holding loose-leaf pages, the mechanism comprising a housing and a plurality of rings for holding the loose-leaf pages, each ring including a first ring member and a second ring member, the first ring member being movable relative to the housing and the second ring member between a closed position and an opened position, in the closed position the first and second ring members forming a continuous, closed loop for allowing loose-leaf pages retained by the rings to be moved along the rings from one ring member to the other, and in the opened position the first and second ring members forming a discontinuous, open loop for adding or removing loose-leaf pages from the rings, a pair of hinge plates supported by the housing for pivotal motion of the hinge plates with respect to the housing, the hinge plates having an upper surface facing the housing and a lower surface facing away from the housing, the first and second ring members being mounted on respective hinge plates and moveable with pivoting motion of the hinge plates between the opened and closed positions, the ring members extending from the lower surface of the hinge plate, the first and second ring members being mirror images of each other, each of said ring members having a length and at least two different non-infinite radii of curvature along said length and outside the housing when the rings are closed, the ring members each comprising a lower segment, a middle segment and an upper segment, the middle segment having a non-infinite radius of curvature greater than 2 inches, wherein when the ring members are in the closed position the lower segments of the ring members extend outward beyond opposite sides of the housing to a respective bend where the lower segments are joined with the respective middle segments, the bends being at a location where the rings have a maximum width and being positioned no higher than a top of the housing.

2. The ring binder mechanism as set forth in claim 1 wherein the lower segment extends laterally outward from the housing, the middle segment extends upward from the lower segment away from the housing, the upper segment extends over the housing, the middle segment is more straight than the lower and upper segments.

3. The ring binder mechanism as set forth in claim 2 wherein the middle segment is longer than the lower and upper segments.

4. The ring binder mechanism as set forth in claim 3 wherein the lower and upper segment each have bends, the bend of the lower segment having a smaller radius of curvature than the bend of the upper segment.

5. The ring binder mechanism as set forth in claim 4 wherein the lower and upper segments each include a radius of curvature of no greater than about 0.1 inches.

6. The ring binder mechanism as set forth in claim 3 wherein upper segments of the first and second ring members further comprise tips, the tip of the first ring member being engageable with the tip of the second ring member in the closed position of the rings at a location aligned with a longitudinal axis of the housing, the tip of the first ring member having a configuration different than the tip of the second ring member.

7. The ring binder mechanism as set forth in claim 2 wherein the upper segments of the first and second ring members cooperatively define a straight segment in the closed positions of the rings.

8. The ring binder mechanism as set forth in claim 2 wherein the housing has cutouts for receiving the lower segments of each of the ring members.

9. The ring binder mechanism as set forth in claim 1 wherein the ring members comprise cylindrical rods.

10. The ring binder mechanism as set forth in claim 1 in combination with a ring binder, the ring binder mechanism being mounted on the ring binder.

11. A ring binder mechanism for holding loose-leaf pages, the mechanism comprising a housing and a plurality of rings for holding the loose-leaf pages, each ring including a first ring member and a second ring member, the first ring member being movable relative to the housing and the second ring member between a closed position and an opened position, in the closed position the first and second ring members forming a continuous, closed loop for allowing loose-leaf pages retained by the rings to be moved along the rings from one ring member to the other, and in the opened position the first and second ring members forming a discontinuous, open loop for adding or removing loose-leaf pages from the rings, a pair of hinge plates supported by the housing for pivotal motion of the hinge plates with respect to the housing, the hinge plates having an upper surface facing the housing and a lower surface facing away from the housing, the first and second ring members being mounted on respective hinge plates and moveable with pivoting motion of the hinge plates between the opened and closed positions, the first and second ring members being mirror images of each other, each of said ring members having a middle segment extending vertically upward from the housing and being adapted to receive a stack of loose-leaf pages, wherein each middle segment slopes inward toward the other as the middle segments extend away from the housing in the closed position, and wherein each middle segment has a non-infinite radius of curvature greater than 2 inches;

wherein the rings have a lower segment and when the ring members are in the closed position the lower segments of the ring members extend outward beyond opposite sides of the housing to a respective bend where the lower segments are joined with the respective middle segments, the bends being at a location where the rings have a maximum width, each bend being positioned on a plane containing the hinge plate for the respective ring member.

12. The ring binder mechanism as set forth in claim 11 wherein each ring member has an upper segment, the upper segment having a length being between about 75% and about 100% of a length of the lower segment.

13. The ring binder mechanism as set forth in claim 11 wherein each of the ring members has a height and the middle segment of each ring member has a height, the height of the middle segment being greater than about 33 percent the height of the ring member.

14. The ring binder mechanism as set forth in claim 13 wherein the height of the middle segment is greater than about 50 percent the height of the ring member.

15. The ring binder mechanism as set forth in claim 14 wherein the height of the middle segment is greater than 60 percent the height of the ring member.

16. The ring binder mechanism as set forth in claim 11 wherein upper segments of the first and second ring members cooperatively have a radius of curvature of greater than about 2 inches in the closed position of the rings.

17. The ring binder mechanism as set forth in claim 11 in combination with a stack of loose-leaf pages adapted to be received by the rings of the mechanism.

18. The ring binder mechanism as set forth in claim 17 wherein the stack of loose-leaf pages has a height and the rings have a height, the height of the stack of loose-leaf pages being greater than 50 percent the height of the rings.

19. The ring binder mechanism as set forth in claim 11 in combination with a ring binder, the ring binder mechanism being mounted on the ring binder.

20. A ring binder mechanism for holding loose-leaf pages, the mechanism comprising a housing and a plurality of rings for holding the loose-leaf pages, each ring including a first ring member and a second ring member, the first ring member being movable relative to the housing and the second ring member between a closed position and an opened position, in the closed position the first and second ring members forming a continuous, closed loop for allowing loose-leaf pages retained by the rings to be moved along the rings from one ring member to the other, and in the opened position the first and second ring members forming a discontinuous, open loop for adding or removing loose-leaf pages from the rings, a pair of hinge plates supported by the housing for pivotal motion of the hinge plates with respect to the housing, the hinge plates having an upper surface facing the housing and a lower surface facing away from the housing, the first and second ring members being mounted on respective hinge plates and moveable with pivoting motion of the hinge plates between the opened and closed positions, the ring members extending from the lower surface of the hinge plates laterally outward beyond opposite sides of the housing, the first and second ring members each being shaped so that in the closed position they cooperatively define a straight top section of the ring opposite the housing and so segments of the ring members corresponding to a location where the rings have a maximum width in the closed position are positioned no higher than a top of the housing, wherein each ring member comprises a middle segment having a non-infinite radius of curvature greater than 2 inches.

21. The ring binder mechanism as set forth in claim 20 wherein the housing has opposite longitudinal edges and each of the first and second ring members comprises a lower segment connected to a respective one of the hinge plates, the middle segment and an upper segment, the lower segment extending laterally outward from a respective one of the longitudinal edges of the housing a distance greater than a cross-sectional diameter of the ring member.

22. The ring binder mechanism as set forth in claim 21 wherein the top section has a length and the housing has a width, the length of the top section being at least about equal to the width of the housing.

23. The ring binder mechanism as set forth in claim 20 wherein the top section has a length and the housing has a width, the length of the top section being about equal to the width of the housing.

24. The ring binder mechanism as set forth in claim 20 wherein the top section has a radius of curvature of greater than about 2 inches.

25. A ring binder mechanism for holding loose-leaf pages, the mechanism comprising a housing and a plurality of rings for holding the loose-leaf pages, each ring including a first ring member and a second ring member, the first ring member being movable relative to the housing and the second ring member between a closed position and an opened position, in the closed position the first and second ring members forming a continuous, closed loop for allowing loose-leaf pages retained by the rings to be moved along the rings from one ring member to the other, and in the opened position the first and second ring members forming a discontinuous, open loop for adding or removing loose-leaf pages from the rings, the first and second ring members being mirror images of each other, each of said ring members comprising a first segment having a first radius of curvature, a second segment having a second radius of curvature, and a third segment disposed between the first and second segments and having a third, non-infinite radius of curvature greater than said first radius of curvature and said second radius of curvature, said first segment being disposed below an upper extent of the housing, wherein the second radius of curvature is different from the first radius of curvature, and wherein the rings have a maximum width at a location having an elevation no higher than a top of the housing, the third radius of curvature being greater than 2 inches.

26. A ring binder mechanism for holding loose-leaf pages, the mechanism comprising a housing and a plurality of rings for holding the loose-leaf pages, each ring including a first ring member and a second ring member, the first ring member being movable relative to the housing and the second ring member between a closed position and an opened position, in the closed position the first and second ring members forming a continuous, closed loop for allowing loose-leaf pages retained by the rings to be moved along the rings from one ring member to the other, and in the opened position the first and second ring members forming a discontinuous, open loop for adding or removing loose-leaf pages from the rings, the first and second ring members being mirror images of each other, each of said ring members comprising a first segment having a first radius of curvature, a second segment having a second radius of curvature, and a third segment disposed between the first and second segments and having a third, non-infinite radius of curvature greater than said first radius of curvature and said second radius of curvature, said first segment being disposed below an upper extent of the housing, wherein the second radius of curvature is no more than about 0.5 inches and the first radius of curvature is less than the second radius of curvature, and wherein the rings have a maximum width at a location having an elevation no higher than a top of the housing, the third radius of curvature being greater than 2 inches.

27. A ring binder mechanism for holding loose-leaf pages, the mechanism comprising a housing and a plurality of rings for holding the loose-leaf pages, each ring including a first ring member and a second ring member, the first ring member being movable relative to the housing and the second ring member between a closed position and an opened position, in the closed position the first and second ring members forming a continuous, closed loop for allowing loose-leaf pages retained by the rings to be moved along the rings from one ring member to the other, and in the opened position the first and second ring members forming a discontinuous, open loop for adding or removing loose-leaf pages from the rings, the first and second ring members being mirror images of each other, each of said ring members comprising a first segment having a first radius of curvature, a second segment having a second radius of curvature, and a third segment having a third, non-infinite radius of curvature greater than said first radius of curvature and said second radius of curvature, said first segment being disposed below an upper extent of the housing, wherein the third segment extends between and interconnects the first and second segments and the first radius of curvature is no more than about 0.1 inches, and wherein the rings have a maximum width at a location having an elevation no higher than a top of the housing, the third radius of curvature being greater than 2 inches.

* * * * *